US010837435B1

(12) United States Patent
Myers

(10) Patent No.: US 10,837,435 B1
(45) Date of Patent: Nov. 17, 2020

(54) HIGH-VOLUME DIAPHRAGM WITH GEOMETRICALLY ENHANCED REINFORCEMENT

(71) Applicant: Douglas D. Myers, Jacksonville, FL (US)

(72) Inventor: Douglas D. Myers, Jacksonville, FL (US)

( * ) Notice: Subject to any disclaimer, the term of this patent is extended or adjusted under 35 U.S.C. 154(b) by 0 days.

(21) Appl. No.: 16/814,986

(22) Filed: Mar. 10, 2020

(51) Int. Cl.
*F04B 43/00* (2006.01)

(52) U.S. Cl.
CPC ..... *F04B 43/0063* (2013.01)

(58) Field of Classification Search
CPC ..... F04B 43/0063; F04B 43/0054
USPC ..... 92/96, 99, 100
See application file for complete search history.

(56) References Cited

U.S. PATENT DOCUMENTS 4,218,959 A 8/1980 Numaguchi et al.
6,158,327 A * 12/2000 Huss ..... F04B 43/0063 92/100
9,121,400 B1 * 9/2015 Myers ..... F04B 17/06
10,030,642 B1 7/2018 Myers

* cited by examiner

*Primary Examiner* — Thomas E Lazo
*Assistant Examiner* — Daniel S Collins
(74) *Attorney, Agent, or Firm* — Mitchell Ghaneie

(57) ABSTRACT

This invention is a high-volume large diaphragm which provides a pair of support sections specially configured to withstand the stresses implemented by an eccentrically actuated pushrod diaphragm pump. The pair of support sections is comprised of an interior support section and an exterior support section that are vertically offset relative to each other's placement on the wall of the high-volume large diaphragm. It is additionally anticipated that more than one pair of offset interior and exterior support sections can be provided on high-volume large diaphragms with significantly greater wall height.

13 Claims, 8 Drawing Sheets

DETAIL VIEW

HIGH-VOLUME DIAPHRAGM WITH GEOMETRICALLY ENHANCED REINFORCEMENT

FIELD OF THE INVENTION

This invention relates generally to diaphragm pumps, and, more particularly, to a high-volume large diaphragm of unitary construction that is comprised of geometrically enhanced reinforcement support sections.

BACKGROUND

Diaphragm pumps are useful for transferring large volumes of fluids (e.g., liquid and gases) for many industries, including but not limited to agricultural, construction and marine industries. Such pumps are commonly utilized for displacing water and may even transfer highly viscous, mud-laden water. However, high-volume large diaphragms, particularly diaphragms with relatively high walls, risk premature failure as a result of augmented effects from distress mechanisms commonly encountered by diaphragms used in diaphragm pumps.

Preferably, a high-volume large diaphragm for use with a diaphragm pump must be capable of operating without failure for a considerable period of time. At a minimum the high-volume large diaphragm should be capable of operating at least 600 hours and ideally at least 1200 hours. It is well known that improperly reinforced high-volume large diaphragms tend to fail after less than 600 hours of use.

Although there are various diaphragm reinforcements disclosed within the prior art, they are incapable of extending, and in some cases may even result in reducing, the service life of a high-volume large diaphragm. In order to considerably extend the service life of the high-volume large diaphragm it is necessary that the high-volume large the distress mechanisms encountered during operation. With such geometrically enhanced reinforcement, the high-volume large diaphragm can be in use for at least 1,200 hours. The invention is intended to solve one or more of the issues noted above.

SUMMARY OF THE INVENTION

In an implementation of the invention, a high-volume large diaphragm with geometrically enhanced reinforcement is provided.

In an embodiment, a high-volume large diaphragm is hat shaped in an undisturbed state. The vertical height of the wall (e.g. the wall height) of the high-volume large diaphragm, measured from the bottom surface of the diaphragm cap to the top surface of the diaphragm rim, is at least three inches. The wall of a high-volume large diaphragm has a maximum diameter of at least three times the wall height and a minimum diameter of at least twice the wall height.

The design of the high-volume large diaphragm's wall is of importance to its functionality and its durability. The actuation of the high-volume large diaphragm results in periodic alternating stresses within the diaphragm wall. There are several Furthermore, when a diaphragm pump uses an eccentrically driven pushrod is used to actuate a high-volume large diaphragm the elliptical trajectory of the pushrod amplifies the magnitude of alternating stresses.

The stresses imparted on the diaphragm wall are optimally resisted by a wall that have areas of increased thickness, hereinafter referred to as support sections. However, if the support sections are too thick or too closely spaced the diaphragm wall will be over-reinforced resulting in excessive stress concentrations that develop at the interface of the wall surfaces and support sections. Cracks will often form adjacent to the support sections when the diaphragm wall is over-reinforced as a result of excessive stress concentrations. Failure of the high-volume large diaphragm often occur at or near locations where cracks within the wall have previously formed. In order to more effectively endure the cyclic stresses that develop within the wall of a high-volume large diaphragm, it is of utmost importance that the geometry of the support sections be carefully considered to ensure the service life of the high-volume large diaphragm, and in turn performance of the diaphragm pump, is optimally enhanced.

Additionally, the wall of a high-volume large diaphragm is also subjected to wear from abrasion. Abrasion of the interior wall surfaces can also induce stress amplifications as a result of acute decreased cross-sectional thickness of the diaphragm wall. The diverse applications that the high-volume large diaphragm is equipped to handle can often increase the exposure of the interior wall surfaces to sharp or jagged debris that could abrade or even penetrate the diaphragm wall. Alternating stresses and abrasion are distress mechanisms that impact the wall of a high-volume large diaphragm and in turn the useful service life of the high-volume large diaphragm.

Improvements for a high-volume large diaphragm are comprised of a collection of one or more pairs of continuous, circumferential support sections located on an angled wall. At least one pair of vertically offset exterior and interior circumferential support sections are provided on the wall. Each support section is comprised of a smoothly curved solid projection that protrudes from only one surface of the wall. The support sections are vertically offset from each other such that an exterior support section and an interior support section are not located at the same elevation along the wall.

Further improvements for the high-volume large diaphragm are comprised of an increased wall thickness. Increasing the thickness of a wall improves its geometric stability as well as its resistance to abrasion.

An anticipated embodiment of a high-volume large pump diaphragm has a pumping volume in excess of 250 cubic inches. The high-volume large diaphragm features a hat shaped structure, which includes a wall having a moderately thin-walled surface shaped as a hollow frustum. The wall defines a first end with a first diameter and a second end opposite the first end and having a second diameter. The second diameter is greater than the first diameter. The wall includes an exterior surface and an interior surface. A rim is formed at the second end. The rim is formed as a circular flange extending outwardly from the wall. A disk-shaped cap is formed across the first end and a plurality of openings are provided within the cap.

An exterior support section is located closer to the rim. Importantly, the exterior support section extends only to the exterior. Similarly, the interior support section protrudes only to the interior. A pair of vertically offset support sections, as described above, reduces rolling of the diaphragm wall during compression while also reducing stress concentrations within the wall at the support sections.

NUMBER REFERENCES

Figure 1:
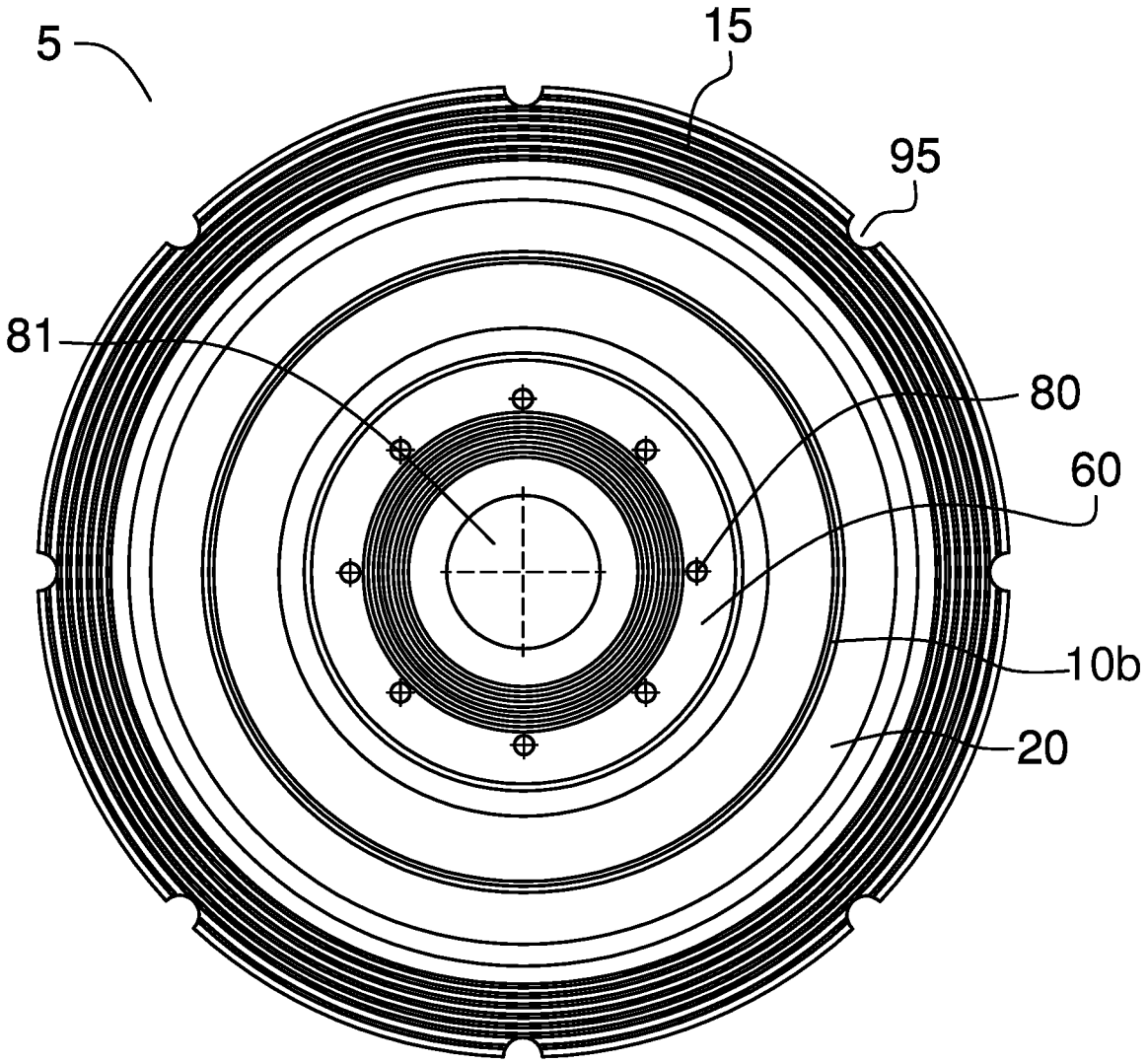
FIG. 1 is a top side view of a first exemplary reinforced high-volume large diaphragm.

5, 6, 7 - - - High-Volume Diaphragm Pump
10 - - - Pair of Support Sections
10*a* - - - Exterior Support Section
10*b* - - - Interior Support Section
12 - - - Second Pair of Support Sections
12*a* Second Exterior Support Section
12*b* - - - Second Interior Support Section
15 - - - Plurality of rim ridges
20 - - - Wall
30 - - - Filleted edge
50 - - - Rim
60 - - - Cap
80,81 - - - Plurality of openings
90 - - - Plurality of cap ridges
95 - - - Alignments cutouts
100 - - - Pushrod
105 - - - Ring Plate

DETAILED DESCRIPTION

A non-limiting embodiment of a high-volume large diaphragm has a pumping volume of at least 250 cubic inches. The high-volume large diaphragm features a hat shaped structure, which includes a wall 20 having a moderately thin-walled surface shaped as a hollow frustum. The wall 20 defines a first end with a first diameter and a second end opposite the first end and having a second diameter. The second diameter is greater than the first diameter. The wall 20 has an exterior surface and an interior surface. The vertical distance between the first end of the wall to the second end of the wall (i.e. the wall height) is at least three inches.

The wall 20 includes structural features at the first end and the second end. A rim 50 is formed at the second end of the wall 20. The rim 50 is comprised of a circular flange extending outwardly from the wall. A cap 60 is formed across the first end of the wall 20. The cap 60 includes a plurality of openings 80, 81. The rim 50 and the cap 60 each include an upper surface and a lower surface. A plurality of concentric rim ridges 15 are formed on the upper surface and the lower surface of the rim 50. Also, a plurality of concentric cap ridges 90 are formed on the upper surface and lower surface of the cap 60.

The wall 20 includes a pair of support sections 10. Each support section of the pair of support section 10 is comprised of a solid projection. Each support section of the pair of support sections is circumferentially continuous around the diaphragm wall. An exterior support section 10*a* is furthest from the rim 50 and protrudes only from the exterior surface of the wall 20 and not from the interior surface of the wall 20. An interior support section 10*b* is closest to the rim 50 and protrudes only from the interior surface of the wall 20 and not from the exterior surface of the wall 20. However, an alternative support section configuration is anticipated to provide the exterior support section 10*a* closest to the rim 50 and the interior support section 10*b* is provided furthest from the rim 50.

It is anticipated that the high-volume large diaphragm comprises relative dimensions defining certain structural features. The thickness of the wall 20 of the high-volume large diaphragm is preferably about 0.170 inches to 0.150 inches, and a pair of support sections 10 that protrude from the wall 20 a distance not greater than one times the wall 20 thickness.

Each of the circumferential support sections 10*a*, 10*b* has a smoothly curved cross section shape comprised of a series of reverse curves. The exterior support section 10*a* is further from the rim 50 relative to the interior support section 10*b* and protrudes only from the exterior surface of the wall 20 and not from the interior surface of the wall 20. The interior support section 10*b* is closer to the rim 50 relative to the exterior support section 10*a* and protrudes only from the interior surface of the wall 20 and not from the exterior surface of the wall 20. The interior support section 10*b* is located approximately at mid height of the wall 20. Each support section 10*a*, 10*b* respectively protrudes from the exterior and interior of the wall 20 a distance not greater than one times the wall thickness. The exterior support section 10*a* is located approximately mid height between the cap 60 and the interior support section 10*b*.

Figure 2:
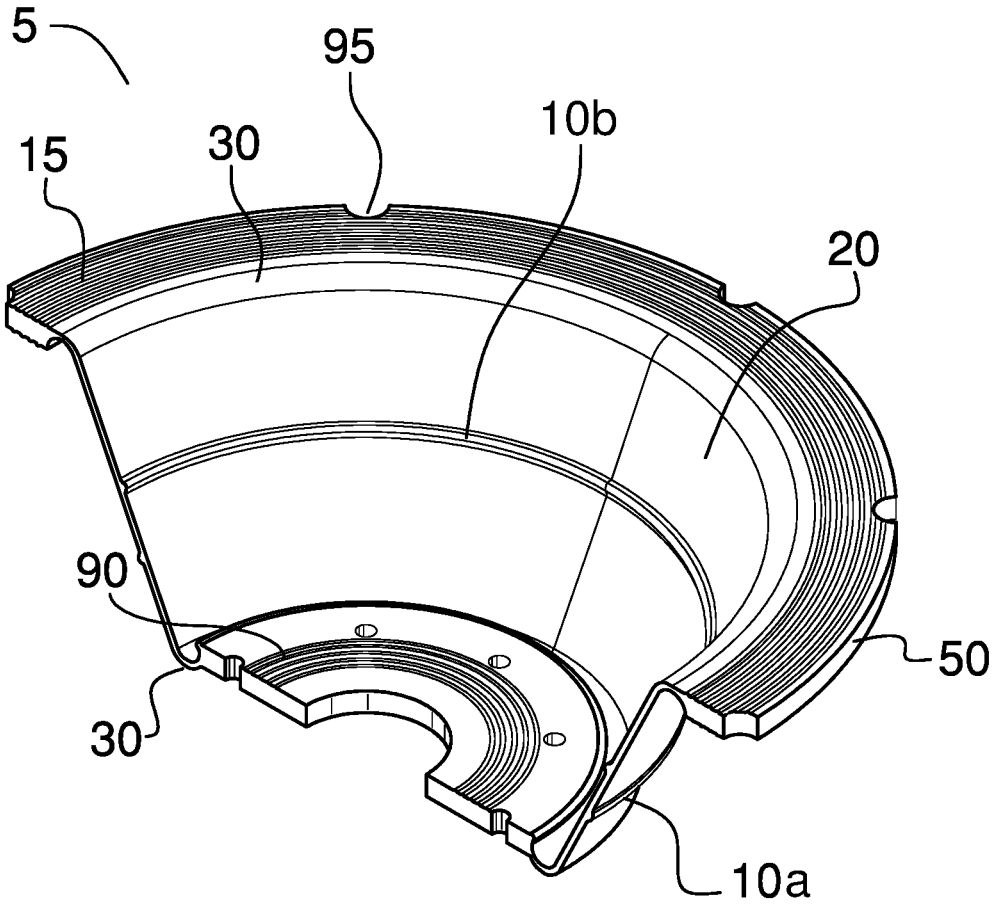
FIG. 2 is a first perspective view of a section of a first exemplary reinforced high-volume large diaphragm.
Figure 3:
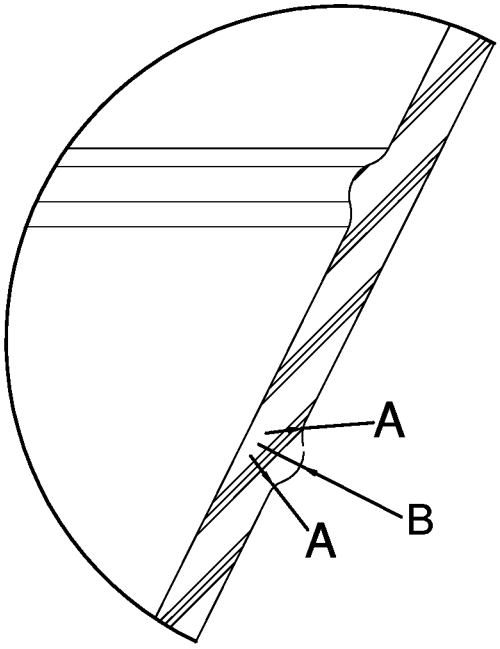
FIG. 3 is a side view of a section of a first exemplary reinforced high-volume large diaphragm and an enlarged detail view of a pair of support sections on a first exemplary reinforced high-volume large diaphragm.
Figure 3:
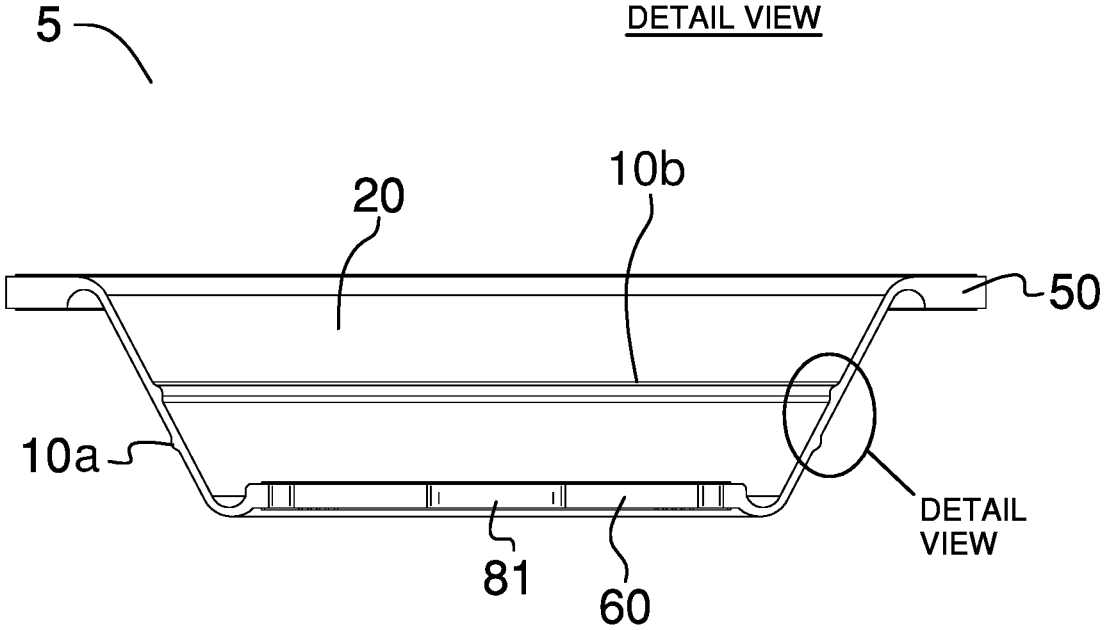

Referring now to FIGS. 1 through 3, various views of a geometrically enhanced reinforced high-volume diaphragm 5 are provided. The high-volume diaphragm 5 is generally hat shaped, with a rim 50 at the nominal bottom, a cap 60 at the nominal top, and a wall 20 protruding from the rim 50 to the cap 60. A first filleted edge 30 provides a transition from the cap 60 to the top portion of the wall 20 and a second filleted edge provides a transition from the rim 50 to the bottom portion of the wall 20. The wall 20 has the shape of a hollow frustum. The angle of the wall 20 is a draft angle for molding. While it is anticipated that the diaphragm 5 is formed via an injection molding process that provides unitary construction of the diaphragm 5, it may also be integrally formed. The diaphragm 5 features a pair of vertically offset support sections 10, comprising an exterior support section 10*a* in the angled wall 20 and an interior support section 10*b* in the angled wall 20. As the high-volume large diaphragm 5 may be oriented other than as depicted, the top of the high-volume large diaphragm 5 or component thereof as shown in FIG. 2 is referred to as the nominal top, and, likewise, the bottom of the diaphragm or component thereof as shown in FIG. 2 is referred to as the nominal bottom.

The support sections 10*a*, 10*b* are comprised of continuous circumferential areas of increased thickness along the wall 20 that smoothly transition from the wall 20 using a series of reverse curves. It is well known that a reverse curve is defined by a reversal of the concavity of the curve. The series of reverse curves are comprised of three reverse curves of which the upper and lower reverse curves have equal radii that are smaller relative to the radius of the middle curve. The detail view in FIG. 3 provides further illustrative reference to this dimensional relationship.

The exterior of the diaphragm 5 is illustrated in FIGS. 2 and 3. The interior of the diaphragm is shown in FIGS. 1, 2, and 3. In use, the cap 60 is forced towards the rim 50, forcing fluid out of the interior space. The interior support section 10*b* is shown in FIGS. 1, 2, and 3. The arrangement of support sections 10*a*, 10*b* as shown in FIGS. 1 through 3 reduces rolling of the diaphragm wall 20 as the pushrod 100 traverses towards the diaphragm 5 and reduces wrinkling of the wall 20 as the pushrod 100 traverses away from the diaphragm 5. In other words, the reduction in mechanical strain from the pair of vertically off-set support sections 10 results in a reduction in alternating stresses.

The pushrod 100 is attached to an eccentric sheave driven by the motor of the diaphragm pump. As the pushrod 100 rotates about the eccentric sheave its inclination varies which results in an eccentric force being applied to the high-volume large diaphragm 5. The eccentric force imparted on the high-volume large diaphragm 5 from the pushrod 100 creates additional stresses in the high-volume large diaphragm 5 that amplify the alternating stresses. The configuration of the pair of vertically offset support sections 10 optimally reinforce the walls of the high-volume large diaphragm 5 to resist these additional stresses resulting from the eccentrically driven pushrod 100.

In the exemplary embodiment, the of the support sections 10*a*, 10*b* do not protrude from the wall 20 by more than one times the thickness of the wall 20. The thickness of the wall 20 of the exemplary diaphragm 5 is about 0.150 inches. The exterior support section 10*a* protrudes from the exterior surface of the wall 20 up to one times the thickness of the wall 20, preferably a maximum of about 0.5 to 0.6 times the thickness of the wall 20. The interior support section 10*b* protrudes from the exterior surface of the wall 20 up to one times the thickness of the wall 20, preferably a maximum of about 0.5 to 0.6 times the thickness of the wall 20.

Figure 7:
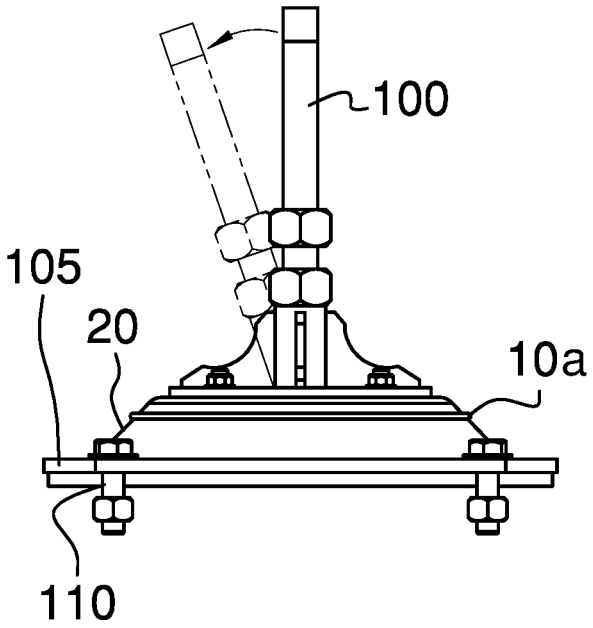
FIG. 7 is a side view of a diaphragm attached to a pushrod being eccentrically pulled in an upward motion.
Figure 8:
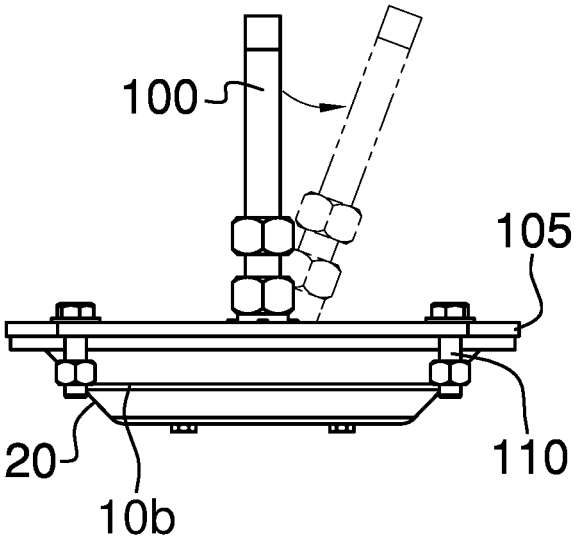
FIG. 8 is a side view of a diaphragm attached to a pushrod being eccentrically pushed in a downward motion.

The rim 50 is a flange that extends peripherally outwardly (e.g., about 1 inch outwardly) at the base of the wall 20. A plurality of concentric shallow rim ridges 15 are formed on the top surface and bottom surface of the rim 50. The rim ridges 15 provide seals and improve the traction of the surfaces when the rim 50 is clamped for operation. A plurality of alignment cutouts 95 are provided in the free edge of the rim 50. When installed, the rim 50 is clamped between a mounting surface and a ring plate 105 (FIG. 7 and FIG. 8). Shanks of bolts 110 protrude through the ring plate 105 into the mounting surface. The alignment cutouts 95 align with the shank of each bolt 110, such that the shank protrudes through the concavity.

Opposite the rim 50, a disc-shaped cap 60 extends from the narrower end of the wall 20. The interior surface of the wall 20 is visible in FIGS. 1, 2, and 3. The plurality of openings 80, 81 is provided in the cap 60. A plurality of concentric shallow cap ridges 90 are formed on the top surface and bottom surface of the cap 60. The cap ridges 90 provide seals and increased traction between abutting surfaces when the cap 60 is clamped to the pushrod 100 for installation.

This invention is not limited to use with a particular pumping mechanism. However, the invention is optimally reinforced for use with a pumping mechanism that is comprised of a pushrod 100 that is positively connected to the diaphragm 5.

In an embodiment, a diaphragm 5 is comprised of a thermoplastic elastomer (TPE), and more particularly a thermoplastic vulcanizate (TPV), and even more particularly Exxon Mobile Corporation's Santoprene™ TPV. Santoprene™ TPV is a dynamically vulcanized alloy comprised of cured EPDM rubber particles encapsulated in a polypropylene (PP) matrix. Santoprene™ TPV has been found effective for such a diaphragm 5, providing flexibility (elasticity and resilience) and acceptable structural integrity for long-term performance. Additionally, in a non-limiting exemplary embodiment, the diaphragm 5 is via injection molding.

Figure 4:
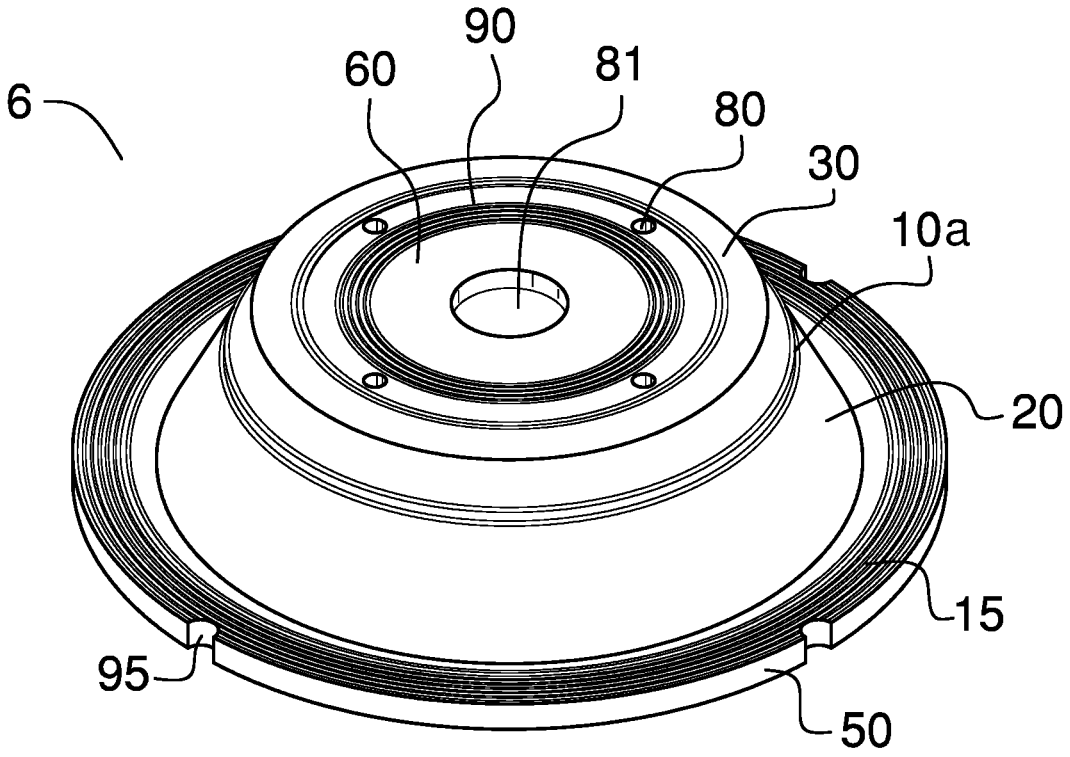
FIG. 4 is a perspective view of a second exemplary reinforced high-volume large diaphragm.
Figure 5:
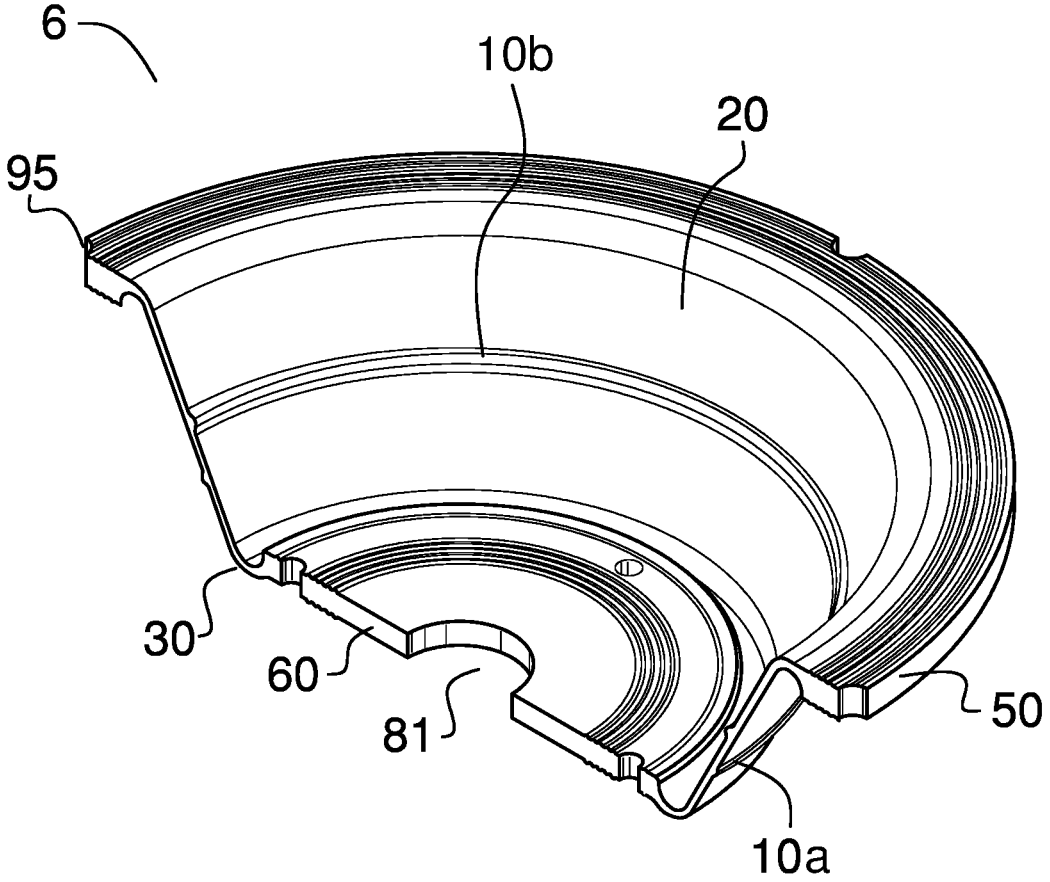
FIG. 5 is a perspective view of a section of a second exemplary reinforced high-volume large diaphragm.

In another embodiment as shown in FIGS. 4 and 5, a diaphragm 6 further includes a rim 50 with a reduced plurality of alignment cutouts 95.

Figure 6:
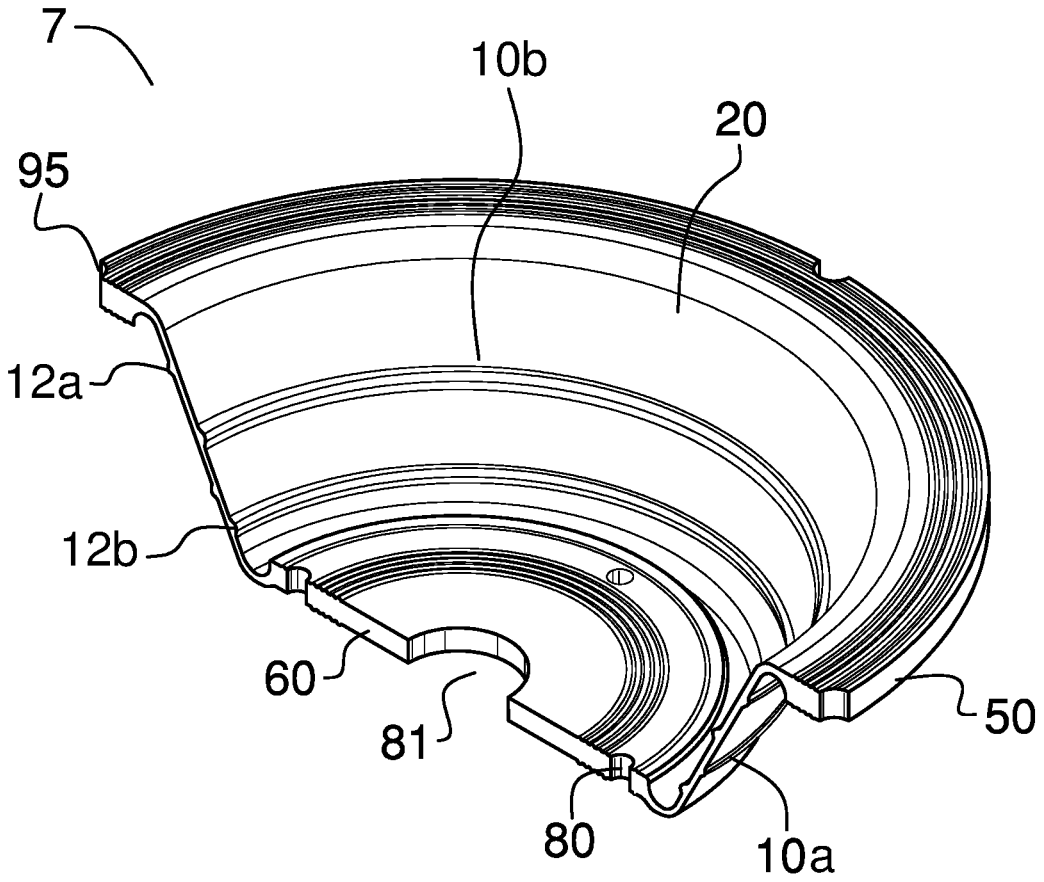
FIG. 6 is a perspective view of a section of a third exemplary reinforced high-volume large diaphragm.

In another embodiment as shown in FIG. 6, a diaphragm 7 is anticipated providing a pair of vertically offset support sections 10 and a second pair of vertically off-set ridges 12. Providing more than one pair of vertically offset support sections 10, 12 enhances durability of high-volume large diaphragms that have significantly greater wall height and prone to amplified stresses.

While the embodiments of the invention have been disclosed, certain modifications may be made by those skilled in the art to modify the invention without departing from the spirit of the invention.

What is claimed is:

1. A high-volume large diaphragm comprising a hat shaped structure, the hat shaped structure comprising:

a. a wall;
  wherein the wall is shaped as a hollow frustum;
  the wall provides a first end with a first diameter and a second end opposite the first end and having a second diameter;
  the second diameter being greater than the first diameter;
  the wall including an exterior surface and an interior surface;

b. a rim;
  wherein the rim is provided at the second end of the wall;
  the rim comprising a circular flange extending outwardly from the wall;

c. a cap;
  wherein the cap is formed across the first end of the wall; and d. a pair of support sections;
  wherein the pair of support sections are formed on the wall;
  the pair support sections having a solid projection that protrudes from the wall;
  the pair of support sections comprising an exterior support section and an interior support section;
  the exterior support section protruding only from the exterior surface of the wall and not from the interior surface of the wall;
  the exterior support section protruding from the interior surface of the wall and not from the exterior surface of the wall;
  the exterior support section and the interior support section being vertically offset relative to each other.

2. The high-volume large diaphragm of claim 1, wherein the high-volume large diaphragm is actuated by an eccentrically driven pushrod.

3. The high-volume large diaphragm of claim 1, wherein the exterior support section is provided further from the rim relative to the interior support section.

4. The high-volume diaphragm of claim 1, wherein the interior support section is provided further from the rim relative to the exterior support section.

5. The high-volume diaphragm of claim 1, wherein the exterior support section is provided approximately equidistant from the interior support section and the cap.

6. The high-volume large diaphragm of claim 1, wherein each support section of the pair of circumferential support sections has a smoothly curved cross section shape formed by a series of three reverse curves of which the lower and upper reverse curves have an equal radii that are smaller than the radius of the middle reverse curve.

7. A high-volume large diaphragm comprising a hat shaped structure, the hat shaped structure comprising:

a. a wall;

wherein the wall is shaped as a hollow frustum;

the wall provides a first end with a first diameter and a second end opposite the first end and having a second diameter;

the second diameter being greater than the first diameter;

the wall including an exterior surface and an interior surface;

b. a rim;

wherein the rim is provided at the second end of the wall;

the rim comprising a circular flange extending outwardly from the wall;

c. a cap;

wherein the cap is formed across the first end of the wall;

wherein the cap is attached to an eccentrically driven push rod;

d. a pair of support sections;

wherein the pair of circumferential support sections are unitarily constructed on the wall;

the pair of support sections comprising a solid projection that protrudes from the wall;

the pair of support sections including an exterior support section and an interior support section;

each support section of the pair of support sections providing a smoothly curved cross section shape formed by a series of reverse curves;

the exterior support section and the interior support section being vertically offset relative to each other;

the exterior support section protruding only from the exterior surface of the wall and not from the interior surface of the wall;

the interior support section protruding from interior surface and not from the exterior surface of the wall.

8. The high-volume large diaphragm of claim 7, wherein the high-volume large diaphragm is actuated by an eccentrically driven pushrod.

9. The high-volume large diaphragm of claim 7, wherein the exterior support section is provided furthest from the rim relative to the interior support section.

10. The high-volume diaphragm of claim 7, wherein the interior support section is provided further from the rim relative to the exterior support section.

11. The high-volume diaphragm of claim 7, wherein the exterior support section is provided approximately equidistant from the interior support section and the cap.

12. The high-volume large diaphragm of claim 7, wherein each support section of the pair of circumferential support sections protrude from the wall a distance equal to or less than one time of the wall thickness.

13. The high-volume large diaphragm of claim 7, wherein the series of reverse curves that defines the cross-section of each of the support sections are comprised of a lower and upper reverse curve that have equal radii that are smaller relative to the radius of the middle reverse curve.

* * * * *